US011383123B2

(12) United States Patent
Reibman et al.

(10) Patent No.: US 11,383,123 B2
(45) Date of Patent: Jul. 12, 2022

(54) WEIGHTLIFTING ACCESSORY

(71) Applicant: Benjamin H. Reibman, Philadelphia, PA (US)

(72) Inventors: Benjamin H. Reibman, Philadelphia, PA (US); Jerrod W. Coning, Ashland, OH (US); Evan J. Larrick, Westerville, OH (US)

(73) Assignee: Benjamin Harold Reibman, West Lafayette, IN (US)

( * ) Notice: Subject to any disclaimer, the term of this patent is extended or adjusted under 35 U.S.C. 154(b) by 285 days.

(21) Appl. No.: 16/710,305

(22) Filed: Dec. 11, 2019

(65) Prior Publication Data

US 2020/0188723 A1 Jun. 18, 2020

Related U.S. Application Data

(60) Provisional application No. 62/779,169, filed on Dec. 13, 2018.

(51) Int. Cl.
*A63B 21/072* (2006.01)
*A63B 21/00* (2006.01)

(52) U.S. Cl.
CPC ..... *A63B 21/4035* (2015.10); *A63B 21/0724* (2013.01)

(58) Field of Classification Search
None
See application file for complete search history.

(56) References Cited

U.S. PATENT DOCUMENTS

| | | | | |
|---|---|---|---|---|
| 4,231,569 | A | 11/1980 | Rae | |
| 4,252,316 | A | 2/1981 | Price | |
| 4,312,506 | A | 1/1982 | Brennan | |
| 4,880,229 | A | 11/1989 | Broussard | |
| 4,900,015 | A | 2/1990 | Dissinger | |
| 4,943,052 | A * | 7/1990 | Powers | A63B 21/0724 482/106 |
| 5,211,615 | A * | 5/1993 | Sides | A63B 21/065 482/105 |
| 5,284,463 | A | 2/1994 | Shields | |
| 5,344,375 | A | 9/1994 | Cooper | |
| 5,529,550 | A | 6/1996 | Maycock, Jr. et al. | |
| 5,573,484 | A | 11/1996 | Carpenter | |
| 5,957,818 | A * | 9/1999 | Betournay | A63B 21/065 482/105 |
| 6,371,893 | B1 * | 4/2002 | Redden | A63B 21/065 482/104 |
| 7,201,711 | B2 | 4/2007 | Towley, III et al. | |
| D554,209 | S | 10/2007 | Loucks | |
| 7,311,641 | B2 | 12/2007 | Panagos | |
| D633,961 | S | 3/2011 | Loew et al. | |
| 8,033,964 | B1 | 10/2011 | Chen | |
| 8,047,975 | B1 | 11/2011 | Chen | |

(Continued)

FOREIGN PATENT DOCUMENTS

GB 2318986 5/1998

*Primary Examiner* — Joshua Lee
(74) *Attorney, Agent, or Firm* — K&L Gates LLP

(57) ABSTRACT

A barbell grip for a barbell shaft is disclosed. The grip is removably attachable to the barbell shaft. The grip includes a cantilever grip arm and a brace arm which is normal or oblique to the cantilever grip. A pair of grips may be used when exercising with the barbell, for example, with a modified bench press.

20 Claims, 7 Drawing Sheets

(56) References Cited

U.S. PATENT DOCUMENTS

| | | | | |
|---|---|---|---|---|
| 8,241,189 | B2 | 8/2012 | Kanaoka | |
| 8,574,136 | B1 * | 11/2013 | Burstrom | A63B 69/0057 482/109 |
| 8,992,395 | B2 | 3/2015 | Orakwasi | |
| D734,407 | S | 7/2015 | Gangemi et al. | |
| 9,126,079 | B2 | 9/2015 | Jordan | |
| D764,607 | S | 8/2016 | Craig | |
| 9,526,940 | B2 | 12/2016 | Renk | |
| 9,630,045 | B1 * | 4/2017 | Martin, Sr. | A63B 71/0054 |
| 9,833,654 | B1 * | 12/2017 | Gant | A63B 21/4035 |
| 10,004,970 | B1 * | 6/2018 | Mailander | A63B 21/4035 |
| 10,166,430 | B2 * | 1/2019 | Gangemi | A63B 21/075 |
| 10,188,894 | B2 | 1/2019 | Wang | |
| 10,779,665 | B2 * | 9/2020 | Durfee | A63B 21/4027 |
| 11,130,013 | B2 * | 9/2021 | Tabone | A63B 21/0728 |
| 2005/0085352 | A1 * | 4/2005 | Baxter | A63B 21/0724 482/100 |
| 2006/0105890 | A1 | 5/2006 | Logue | |
| 2006/0252612 | A1 * | 11/2006 | Melcer | A63B 23/0405 482/94 |
| 2009/0088305 | A1 * | 4/2009 | Marethouse | A63B 23/0405 482/139 |
| 2014/0287889 | A1 * | 9/2014 | Grace | A63B 71/0036 482/106 |
| 2017/0144011 | A1 * | 5/2017 | Gangemi | A63B 21/0724 |
| 2018/0296870 | A1 * | 10/2018 | Gangemi | A63B 21/0724 |
| 2019/0351280 | A1 * | 11/2019 | Klecka | A63B 21/4035 |
| 2019/0351281 | A1 * | 11/2019 | Monarrez, Jr. | A63B 21/0724 |
| 2020/0114193 | A1 * | 4/2020 | Tabone | A63B 21/0783 |

* cited by examiner

100

WEIGHTLIFTING ACCESSORY

CROSS-REFERENCE TO RELATED APPLICATIONS

The present application claims priority to U.S. Provisional Patent Application No. 62/779,169 filed on Dec. 13, 2018, the disclosure of which is incorporated herein by reference for all purposes.

BACKGROUND

Weightlifting is a popular exercise activity. Many weightlifting exercises, whether for weight training ancillary to other sports, Olympic lifting, body building or power lifting are performed using barbells. Barbells include a long bar, generally a steel rod with weights removably attached at each end. Weight plates slide onto the outer portions of the bar to increase or decrease the desired total weight to be lifted. Collars are used to prevent plates from moving outward unevenly so that the lifter does not experience uneven force.

In a bench press, an individual presses a weight upwards from a supine position by extending their arms. Usually, the bar is held with a pronated grip, although alternative grips are sometimes used. The exercise works the pectoralis major as well as chest, arm, and shoulder muscles such as the anterior deltoids, serratus anterior, coracobrachialis, scapulae fixers, trapezii, and the triceps. Alternative related exercises may include performing a similar movement from an inclined or declined position.

With certain types of shoulder injuries (and sometimes with age), an individual may suffer shoulder pain, e.g. arising from impingement, when performing a conventional bench press. People who suffer from shoulder injuries often use a specialized barbell such as the Swiss Bar or Football Bar that allows them to hold the bar in a neutral grip, reducing the amount of external rotation on the shoulder when performing a bench press exercise. However, this requires such a specialized bar be available for use. Such a specialized bar may also not always be compatible with standard safety and accessory equipment.

One example embodiment of the present disclosure is barbell grip for a barbell having a barbell shaft with a longitudinal axis. The barbell grip may include an attachment means for removably attaching the barbell grip to a barbell shaft. The barbell grip may also include a cantilever grip arm having an inner end and an outer end, the inner end mechanically coupled to the attachment means, the cantilever grip arm configured to extend from the attachment means normally or obliquely with respect to the longitudinal axis of the barbell shaft when the attachment means is attached to the barbell shaft. The barbell grip may also include a brace arm, having a inner end and an outer end, the inner end of the brace arm mechanically coupled to the attachment means, the brace arm configured to extend from the attachment means normally or obliquely with respect to the longitudinal axis of the barbell shaft and normally or obliquely with respect to the cantilever grip arm when the attachment means is attached to the barbell shaft.

Optionally the example barbell grip may employ, as the attachment means a shaft collar, a clamping shaft collar, a pipe clamp, an o clamp, or mechanically joined brackets, preferably a hinged shaft collar. The example attachment means may further include a closure mechanism configured to secure the attachment means to a barbell shaft. The closure may preferably be a cam lock, and may, for example, also include nuts and bolts, a draw latch, a snap fit, a thumb screw, a set screw, a cam lock, and a ratchet strap/tiedown. For example, the cam locks may be configured to secure a hinged shaft collar in a closed configuration.

Optionally, the brace arm in the example barbell grip may be flared at the outer end. The example brace arm may also include a curved portion, where the curvature of the curved portion has an open side facing the cantilever arm grip. The brace may be curved to conform with the forearm of a person gripping the cantilever grip arm to perform a neutral grip weightlifting exercise with a barbell to which the example barbell grip is attached. Alternatively, the brace arm may further include two arcuate arms extending in opposite directions from the outer end of the brace arm. Optionally, the arcuate arms may form a "c" shape, with an open side of the "c" facing towards the outer end of the cantilever grip arm.

Optionally, the cantilever grip arm may be configured to extend normally to the longitudinal axis of the barbell shaft when the attachment means is attached to the barbell shaft. In an alternative embodiment, the cantilever grip arm may extend at an acute angle with respect to the barbell shaft.

In one alternative embodiment, the brace arm may alternatively be mechanically coupled to the attachment means through the cantilever grip arm.

Optionally, the inner end of the brace arm is configured to extend downwardly from the attachment means with respect to the plane formed by the bar and the cantilever grip arm when the attachment means is attached to the barbell shaft, so that the brace arm forms an acute angle with the cantilever grip arm.

Optionally, in all of the above example embodiments, a bubble level may be attached to one of the cantilever grip arm, the brace arm, or the attachment means, or some other component, to allow correct positioning of the barbell grip on a barbell shaft to be determined.

Another example embodiment of the present disclosure is an exercise device. The device may include a barbell shaft having a longitudinal axis, a midpoint, and a first and second bar end. A first and second weight plate may rest on and be temporarily secured to the first and second bar ends, respectively, of the barbell shaft. Two of any of the above example described example barbell grips may be removably attached to the barbell shaft at two respective points approximately equidistant from the midpoint toward the first and second bar ends respectively, so that the cantilever grip arm of the first barbell grip and the cantilever grip arm of the second barbell grip extend normally or obliquely from the barbell shaft longitudinal axis in the same horizontal plane, and the brace arm of the first barbell grip and the brace arm of the second barbell grip extend downward from the horizontal plane.

Optionally, the cantilever grip arms of the first and second barbell grips may be angled outward from the midpoint away from each other and toward the first and second bar end, respectively.

Optionally, the cantilever grip arms of the first and second barbell grips may extend from the respective attachment means at an angle toward each other and toward the midpoint of the barbell shaft.

Alternatively, the brace arms of the first and second barbell grips may extend from the respective attachment means at an angle away from each other and toward the first and second bar ends, respectively.

Optionally, the example exercise device may include, in the first and second barbell grips a bubble level, the bubble levels including indicators that are configured to have the same reading when the barbell grips are placed in a parallel orientation on the barbell.

Another example embodiment of the present disclosure is a method of exercising using a barbell having a barbell shaft and a longitudinal axis and a first and second end with weight plates of equal weight attached to the first and second end of the barbell, and a pair of barbell grips, like those described above in the first example embodiment. The example method may include positioning the body of a weight lifter on a bench perpendicular to and under the bar with the bar on a rack with the chest below the horizontal plane of the shaft. The example method may also include gripping the first and second barbell grip devices with a neutral grip, the first and second barbell grips being attached to the barbell shaft by their respective attachment means. The example method may also include raising the bar from the rack. The example method may also include lowering the bar toward the chest. The example method may also include raising the bar from the chest so that arms are fully extended by lifting the first and second barbell grips.

Optionally, the example method may also include attaching the first and second barbell grips to the bar in a parallel orientation before positioning the body on the bench. Optionally, after they are attached. The first and second barbell grips may be aligned on the bar using bubble levels attached to the barbell grips.

Optionally, the example method may also include returning the bar to the rack; and after returning the bar to the rack, removing the first and second barbell grips from the bar.

FIG. 4 illustrates the example barbell grip of FIG. 1 from a front view.

Some example embodiments of the present disclosure provide accessory devices, e.g., barbell grips, for use with a standard barbell that allow for a neutral grip to be used in a bench press exercise. These accessory devices may be low cost. Unlike a Swiss bar (or other barbell with neutral grips, e.g., Football bar) bar, they may also be easily portable, so that a weightlifter can easily carry them with gym equipment while traveling. They are also generally compatible with standard rack, bar, and safeties.

In addition to providing a neutral grip bench press, the example accessory devices may also allow for different focus on pectoral and triceps muscles when performing bench presses or modified bench presses. Further exercises may be performed with the device using a barbell a with neutral grip position, e.g., hammer curls, skullcrushers (a tricep extension exercise), overhead press (military press), and pullovers. Exercises similar to neutral grip dumbbell bench press may be performed, but with better control over loading conditions than when dumbbells are used.

Using a standard bench press rather than dumbbells allows the exercise to easily start with the weights in the correct position, using standard weightlifting equipment. Moreover, greater weights can be employed when using the example device and a barbell, than are practical or safe with a dumbbell bench press.

An example barbell grip described herein allows for bench pressing with a neutral grip using a standard barbell and bench press rack, squat rack, power-rack, power cage, flat/incline/decline bench or other barbell weightlifting station which is capable of being used as a bench platform. The example grip non-permanently attaches to a standard barbell. The example grips are intended to be used in pairs, and in some example embodiments they can be easily oriented parallel to each other when attached to the barbell, through the use of bubble level which may be included as part of the device.

Figure 1:
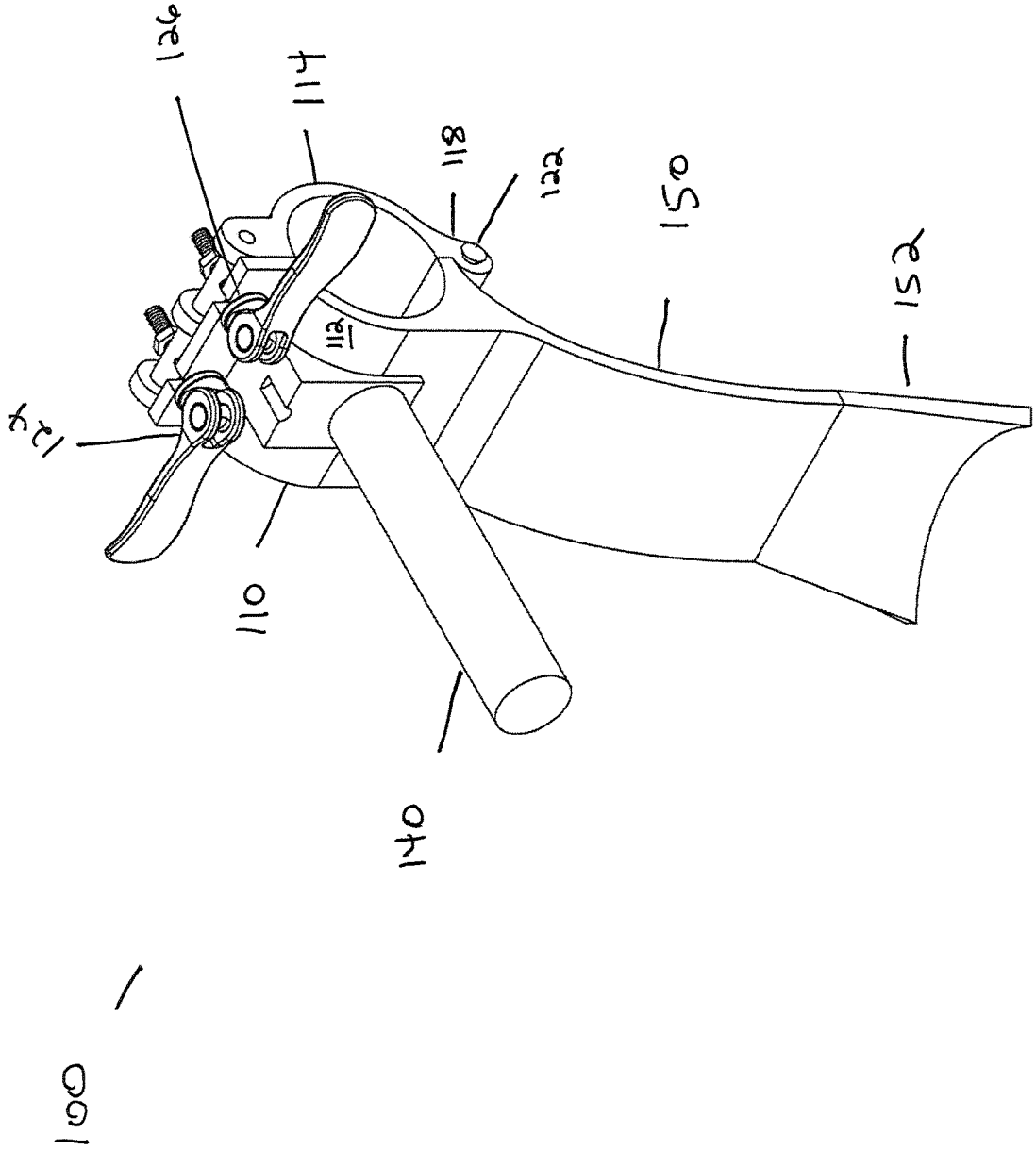
FIG. 1 illustrates an example barbell grip in a close position, according to an example embodiment of the present invention.

FIG. 1 illustrates an example barbell grip 100 in a closed position, according to an example embodiment of the present invention.

A hinged, locking shaft collar 110 may be provided to attach the barbell grip to a barbell shaft. The shaft collar 110 may include two halves 112 and 114, which face each other in the closed configuration, and have an internal bore which mates with the barbell. It will be appreciated that the device does not need to be hinged and may instead be comprised of two or more separate elements which are joined/fastened together. While the illustrated shaft collar 110 is generally cylindrical on the outside, it should be appreciated that the outside shape of the shaft collar is usually irrelevant to the operation of the device, and may be round, square, or other convenient shape. This is in part because the loading of the shaft collar when in the barbell grip is in use is not rotational. Integral hinge elements 116 (not visible in this view) and 118 may be provided as part of shaft collar element 114 and integral hinge element 120 (not visible in this view) may be provided as part of shaft collar element 112. In the alternative, it may be appreciated that a non-integral hinge element could be coupled to the shaft collar using fasteners, welding, adhesives or other joining methods. A hinge pin 122 may be provided through the hinge elements, interconnecting them, so that the hinge elements can be pivoted about the hinge pin to open and/or close the shaft collar 110. Moreover, other sorts of securing approaches besides hinges may also be employed, provided that the device remains easy to attach to and remove from a barbell shaft, and the barbell grip is securely attached to remain in place during lifting exercises with typical loads.

A flange or other protrusion, potentially with holes or slots, may extend from the two halves of the shaft collar 112 and 114. These flanges allow for a locking mechanism, such as the cam locks 124 and 126 to clamp the opposing halves 112 and 114 together. They may have other elements such as pins, hinges, etc. which enable closure mechanisms to swing/rotate to allow for easier opening or closing of the device. It may be appreciated that in place of a hinge another set of protrusions may replace them with the same design as their opposite.

Alternatively, in place of or in addition to the cam locks 124 and 126, one or more other approaches to securing the shaft collar in a closed position on a barbell shaft may be employed, e.g. nuts and bolts, wing nuts, thumb screws, screws, draw latches, locking levers, etc. In place of the shaft collar 110, other approaches to attaching the grip to the barbell shaft may also be employed, such as a pipe clamp, o clamp, c clamp non permanent adhesive, friction fitting or other closure mechanism. A ratchet strap or tie down attachment, similar to the one used in the Croc Lock™ barbell collars from Elite FTS, in London, Ohio, may also be employed.

A cantilever grip arm 140 may be attached to and extend from the shaft collar 110. The cantilever grip arm may preferably have a cylindrical shape and be knurled, coated or otherwise altered for better gripping. The cantilever grip arm 140 element may be, configured to be used in lifting the barbell by a weightlifter using a neutral grip when the shaft collar is attached to a conventional barbell shaft. The cantilever grip arm 140 can be coupled to the shaft collar 110 by any conventional approach, e.g., screw threads, press fit, welding, adhesives, or by being integrally formed as part of the attachment means, etc. It will be appreciated that cantilever grip arm 140 could also be coupled indirectly to the shaft collar, through some additional element, as long as the relative position of the grip and shaft collar were held in the same fixed relative position when the barbell grip 100 is used. As illustrated, the cantilever grip arm 140 may extend normally from the longitudinal axis of the bar when the attachment means is secured to the bar. In an alternative embodiment, the cantilever grip arm 140 may form a slightly acute angle with the longitudinal axis of the bar, while still being in the same plane as the bar. It may be appreciated that a pair of grips may be provided having opposite angles. Such a pair grips can then be employed to provide a user grip which is angled slightly inward or outward with respect to the midpoint of the bar, depending on the relative position of the pair of oppositely angled grips. In some alternatives, e.g., using multiple threaded receiving holes in the housing of the shaft collar and a threaded cantilever grip arm, multiple possible angles of attachment of the cantilever arm grip to the attachment means may be available using the same device.

A brace arm 150 may also extend from the shaft collar 110. Preferably, the angle between the cantilever grip arm 140 and the brace arm 150 near wear they are coupled to the shaft collar 110 will be slightly less than a right angle, although it may also be at a right angle, or at a more acute angle. The brace arm 150 may preferably may be curved along its length and flared toward the outer end to allow for simpler manufacture, and to avoid the thumb when the user grips the cantilever grip element. It may also be appreciated that the flared configuration may reduce stress on the forearm by providing increased contact area for bracing when the barbell grip is in use. At the end opposite the shaft collar, the brace arm element 150 may have a flared portion 152, which conforms better against the arm of the user when the grip is used in a bench press. Preferably the brace arm 150 may have a slightly arcuate shape along its length, with the open curvature facing away from the cantilever grip arm 140. Optionally, padding or other components may be provided to allow better and more comfortable bracing. The brace arm 150 or may be coupled to the attachment means by any conventional approach, e.g., forming it as an integral part of one of the components of the shaft collar, screw threads, welding, adhesives, etc. It will be appreciated that brace arm 150 could also be coupled indirectly to the shaft collar, through some additional element, e.g., by being attached to the cantilever grip arm, as long as the brace arm, cantilever grip arm and shaft collar were held in the same relative position when the barbell grip was in use.

In an alternative embodiment, the brace arm may be rod shaped along all or part of its length. In another alternative embodiment, arcuate arms may extend from the outer end of the brace arm, to form a C-shaped brace, preferably open toward the cantilever grip element.

All of the elements of the barbell grip 100 may be formed from various materials with sufficient strength, e.g., steel (low, medium or high alloys), stainless steel, aluminum, high strength plastics, or composites.

Figure 2:
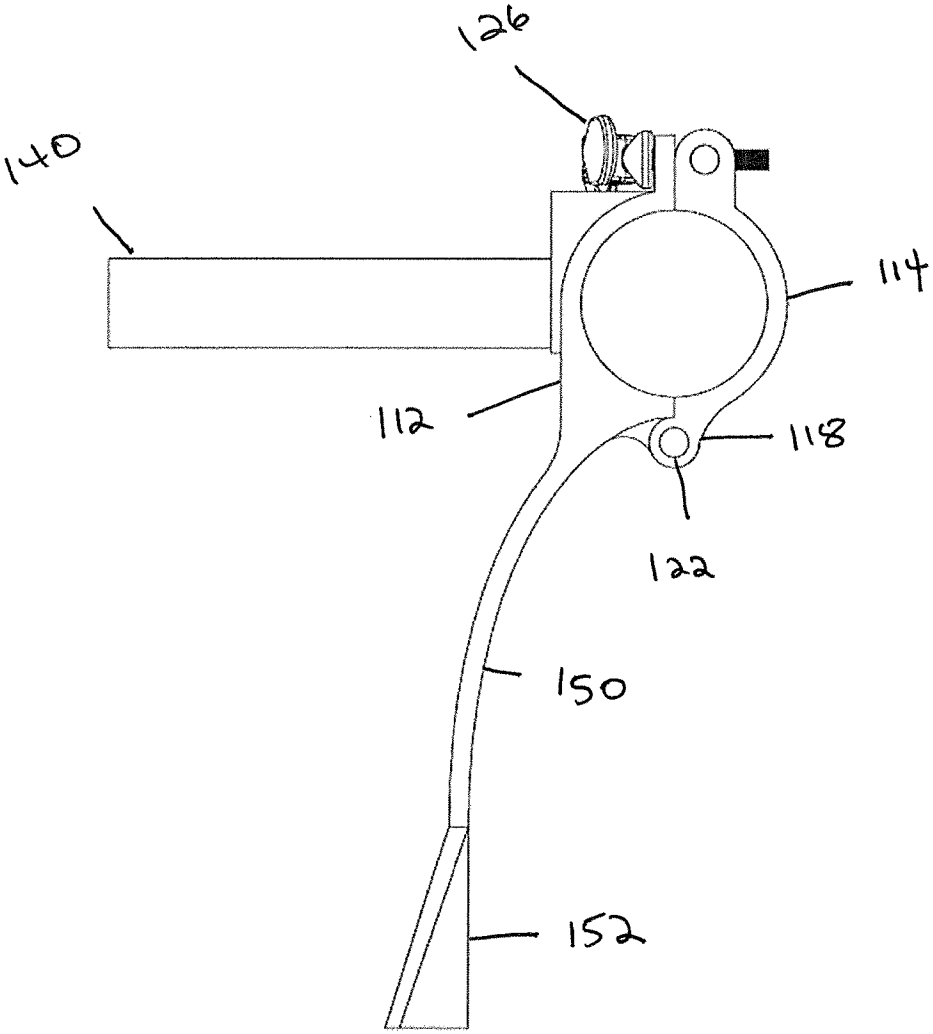
FIG. 2 illustrates the example barbell grip in a closed position from a side view, according to an example embodiment of the present invention.

FIG. 2 illustrates a side view of the example barbell grip 100 of FIG. 1. This would be the view facing one end of a barbell shaft, looking down the longitudinal axis of the shaft, if the barbell grip were attached to the barbell shaft. The cylindrical space between the two shaft collar elements 112 and 114 is more clearly visible than in FIG. 1. When in use this space between 112 and 114 would be occupied by a barbell shaft, and the two shaft collar elements would be compressed against the barbell shift in a locked position, to secure the barbell grip on the barbell shaft. The inner semi-cylindrical surfaces of 112 and 114 may be machined smooth, or appropriate padding or other material may be adhered on the surface to obtain a more secure grip of the barbell shaft and avoid damage to the barbell shaft.

Figure 3:
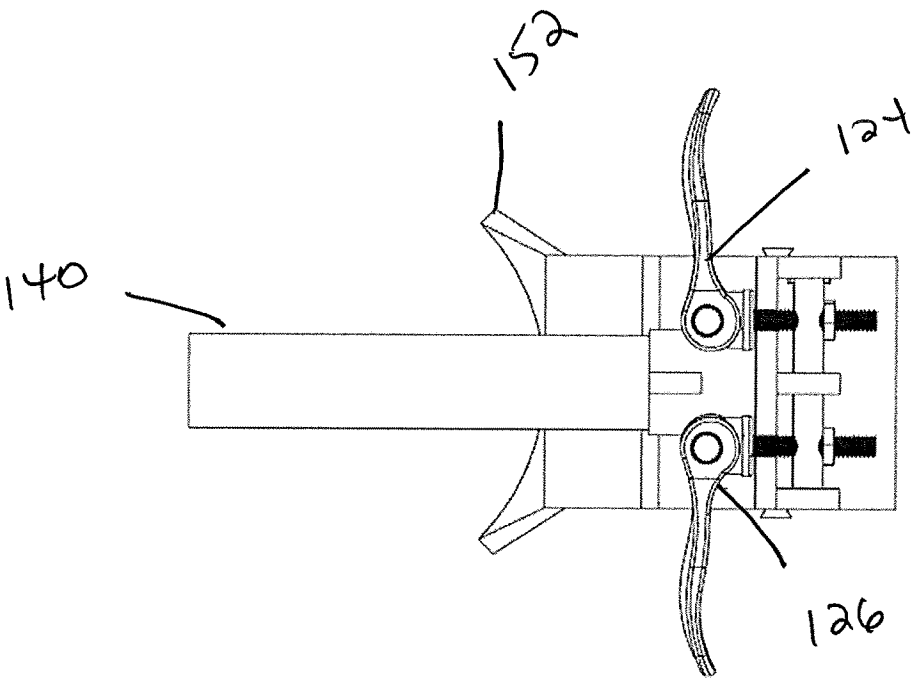
FIG. 3 illustrates the example barbell grip of FIG. 1 from a top view.

FIG. 3 illustrates a top view of the example barbell grip 100 of FIG. 1, according to an example embodiment of the present invention.

FIG. 4 illustrates a front view of the barbell grip of FIG. 1, looking inward from the end of the cantilever grip arm.

Figure 5:
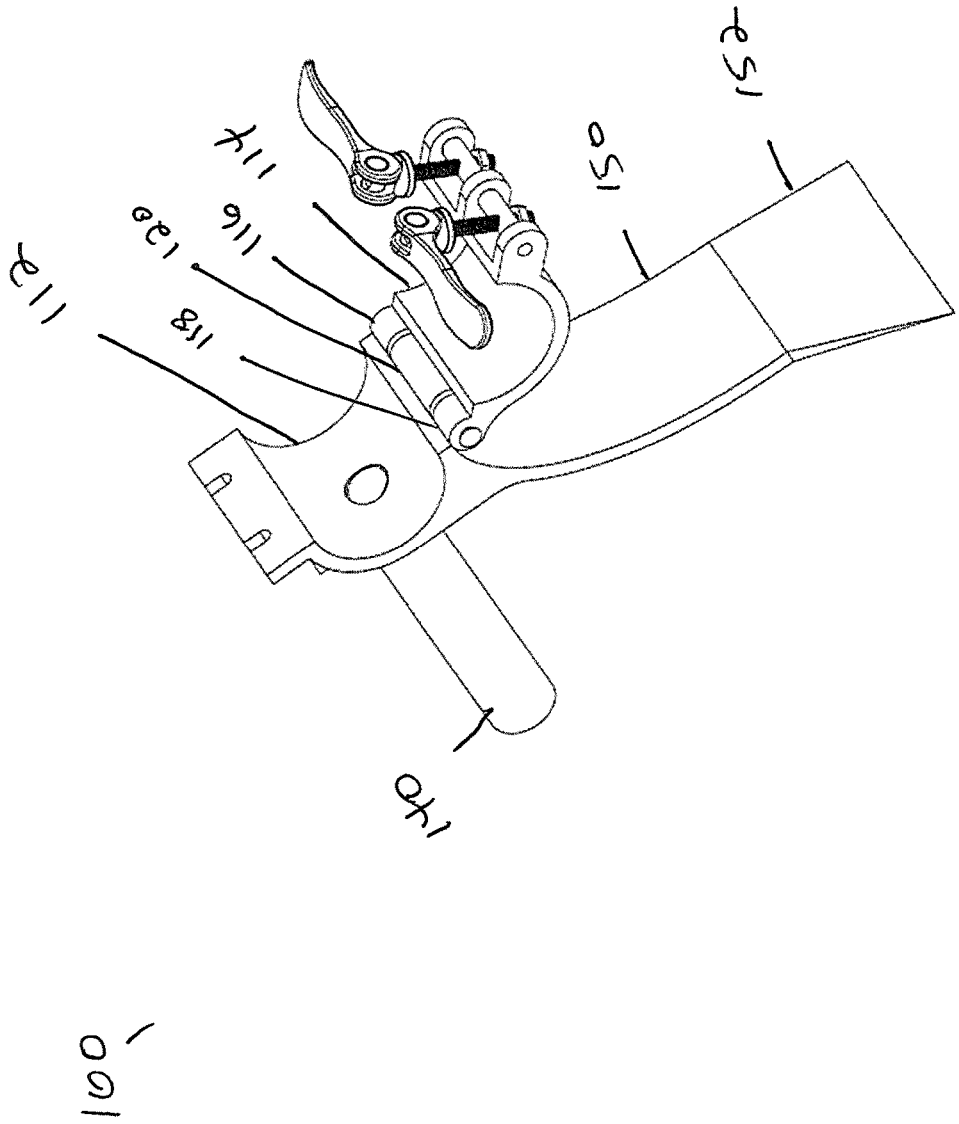
FIG. 5 illustrates the example barbell grip of FIG. 1, in an open position.

FIG. 5 illustrates a view of the barbell grip of FIG. 1, when the grip is in the open position. The hinge elements 114, 116 and 118 are all visible from this view in the open configuration.

Figure 6:
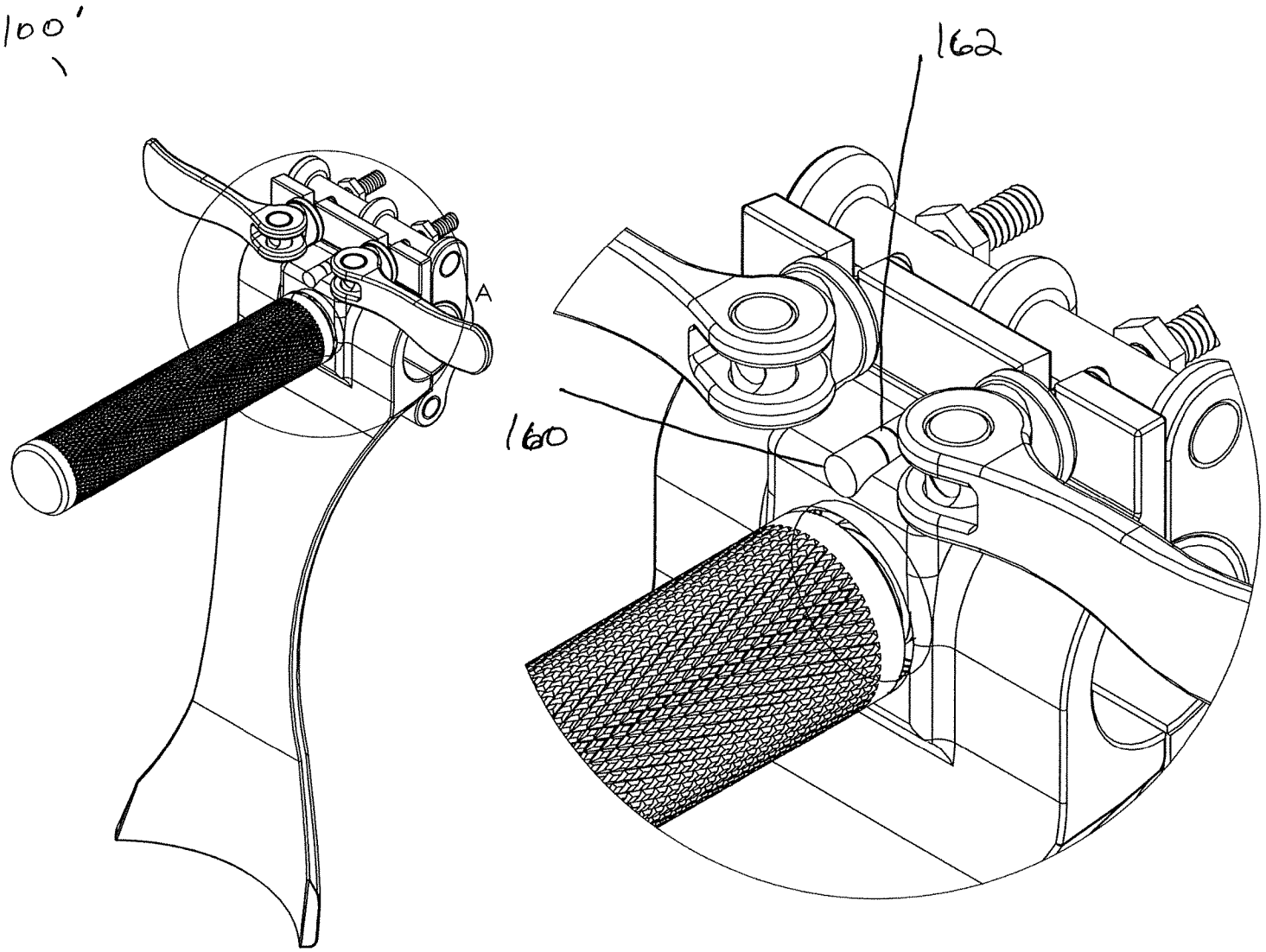
FIG. 6 illustrates a blowup of a portion of FIG. 1, showing the optional bubble level.
Figure 7:
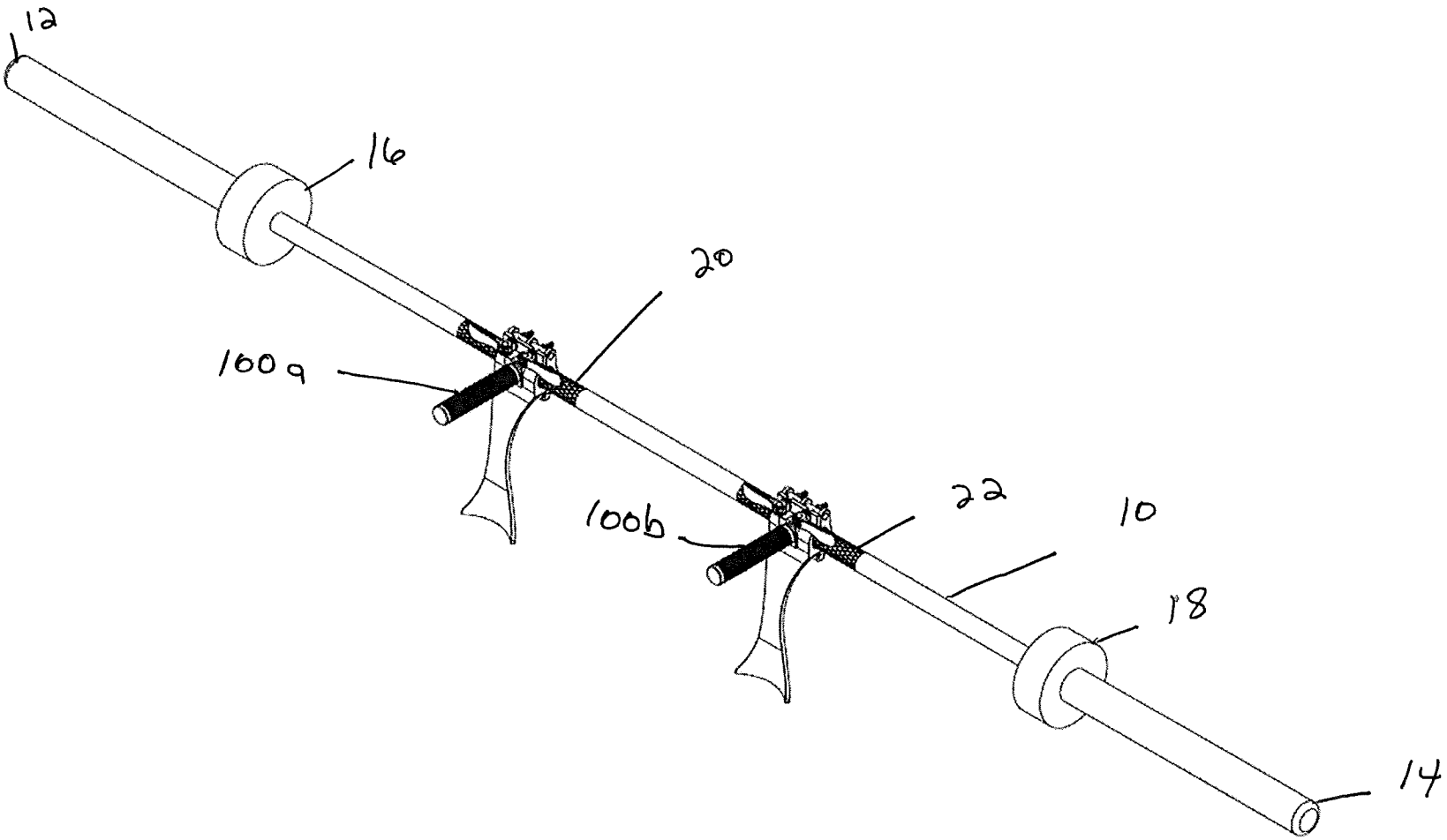

Optionally, a bubble level may be provided as part of the barbell grip 100 to allow a pair of barbell grips to be placed in the identical orientation on a barbell shaft. The bubble level may, e.g., be attached to the cantilever grip arm, the housing of the shaft collar, or the brace arm. FIG. 6 shows an expanded view, from the same perspective as FIG. 1, that details this configuration. The bubble level 160 may include indicia 162 to determine when the barbell grip is in a particular configuration, e.g., with the cantilever grip arm parallel to the floor.

Figure 7:
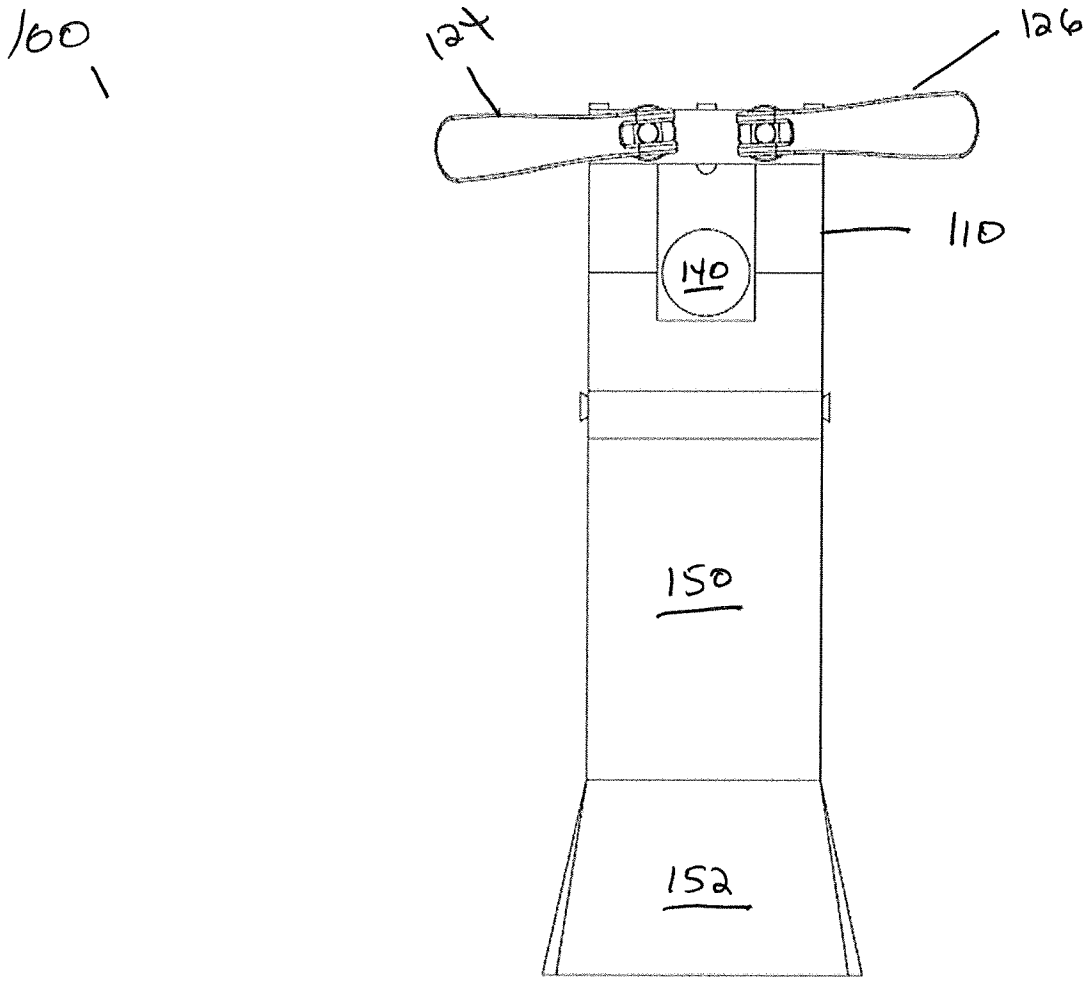
FIG. 7 illustrates two example barbell grips, in a fully closed and secured position, attached to a barbell shaft, according to an example embodiment of the present invention.

FIG. 7 illustrates two example barbell grips, in a fully closed and secured position, attached to a conventional barbell shaft 10, according to an example embodiment of the present invention.

The barbell shaft 10 extends longitudinally from a first end 12 to a second end 14. For Olympic style bars, the ends 12 and 14 may include a rotating sleeve. Collars 16 and 18 may be provided proximate the ends 12 and 14, respectively. Weight plates of various sizes (not shown) may be placed on the ends 12 and 14, usually with identical weights at either end. A removable collar may be added on each end to secure the weight plates. In the middle of the bar, equidistant from the midpoint of the shaft, knurling 20 and 22 may be provided, to improve the ability of a weightlifter to grip the bar.

Attached at to the barbell shaft 10, preferably at points equidistant from the midpoint of the shaft and preferably in the identical orientation are two identical barbell grips 100*a* and 100*b*. Nonequidistant points could be used for exercises favoring one side of the body over the other.

The barbell 10 may be placed on a bench rack or other weightlifting support/fixture. Weights may be attached either before or after placing the bar on the rack or support. The two grips 100*a* and 100*b* may also be attached to the bar either before or after placing the bar on the rack. Optional bubble levels in the grips 100*a* and 100*b* may be used to ensure they are aligned in the same orientation. A weightlifter then assumes a supine position with the back on a bench under the barbell shaft. Usually the feet are placed on the floor beside or beneath the bench. In a conventional bench press, the weightlifter would grip the barbell shaft, usually with a pronated grip, of the knurled portions 20 and 22. The weightlifter would then lift the barbell shaft from the rack and raise and lower the barbell shaft. When the exercise is completed, the barbell shaft is returned to the rack. A spotter may assist during this process.

When the grips 100*a* and 100*b* are attached to the barbell shaft, rather than gripping the knurled portion of the shaft 20, and 22, a weightlifter grips the respective cantilever grip arms of the barbell grips. The bar is lifted by lifting the grips, rather than gripping and lifting the bar directly. Since the cantilever grip arms extend from the bar, the lifter can use a neutral or partially neutral grip, depending on the exact angle the cantilever grip arms extend from the bar. When the bench press exercise is executed, the brace arms may be pressed against the lifter's forearms. This bracing helps to counteract the moment loading on the wrist joint from the off center bar. Bracing can be accomplished either with the barbell on the head side of the hand or the feet side based on user preference.

After the lift, the bar may be returned to the rack, and the barbell grips 100*a* and 100*b* can be removed.

The foregoing description of embodiments of the present disclosure has been provided for the purposes of illustration and description. It is not intended to be exhaustive or to limit the invention to the precise forms disclosed. Obviously, many modifications and variations will be apparent to the practitioner skilled in the art. Such changes and modifications can be made without departing from the spirit and scope of the present subject matter and without diminishing its intended advantages. It is therefore intended that such changes and modifications be covered by the appended claims.

The invention claimed is:

1. A barbell grip for a barbell having a barbell shaft with a longitudinal axis extending from a first end to a second end, a first collar proximate the first end and a second collar proximate the second end, a first end portion of the shaft extending beyond the first collar to the first end and second end portion of the shaft extending beyond the second collar to the second end, the first and second end portions configured to receive weight plates, and a middle portion of the shaft located between the first and second collars, the barbell grip comprising:

an attachment means for removably attaching the barbell grip to the middle portion of the barbell shaft;

a cantilever grip arm having an inner end and an outer end, the inner end mechanically coupled to the attachment means, the cantilever grip arm configured to extend from the attachment means normally or obliquely with respect to the longitudinal axis of the barbell shaft when the attachment means is attached to the barbell shaft; and a brace arm having an inner end and an outer end, the inner end of the brace arm mechanically coupled to the attachment means, the brace arm configured to extend from the attachment means normally or obliquely with respect to the longitudinal axis of the barbell shaft and normally or obliquely with respect to the cantilever grip arm when the attachment means is attached to the barbell shaft, wherein the cantilever grip arm is configured to extend normally to the longitudinal axis of the barbell shaft when the attachment means is attached to the barbell shaft, and wherein the inner end of the brace arm is configured to extend downwardly from the attachment means with respect to a plane formed by the barbell shaft and the cantilever grip arm when the attachment means is attached to the barbell shaft, so that the brace arm forms an acute angle with the cantilever grip arm.

2. The barbell grip of claim 1, wherein the attachment means is chosen from the group consisting of a shaft collar, a clamping shaft collar, a pipe clamp, an o clamp, and mechanically joined brackets.

3. The barbell grip of claim 2, wherein the attachment means further comprises a closure mechanism configured to secure the attachment means to the barbell shaft.

4. The barbell grip of claim 2, wherein the attachment means further comprises a hinged shaft collar and a cam lock configured to secure the hinged shaft collar in a closed configuration.

5. The barbell grip of claim 1, wherein the brace arm is flared at the outer end.

6. The barbell grip of claim 1, wherein the brace arm further comprises a curved portion, the curved portion having an open side facing the cantilever arm grip.

7. The barbell grip of claim 6, wherein the brace arm is curved to conform with the forearm of a person gripping the cantilever grip arm to perform a neutral grip weightlifting exercise with the barbell to which the barbell grip is attached.

8. The barbell grip of claim 1, wherein the brace arm further comprises two arcuate arms extending in opposite directions from the outer end of the brace arm.

9. The barbell grip of claim 8, wherein the arcuate arms form a "c" shape, with an open side of the "c" facing towards the outer end of the cantilever grip arm.

10. The barbell grip of claim 1, wherein the brace arm is mechanically coupled to the attachment means through the cantilever grip arm.

11. The barbell grip of claim 1, further comprising:

a bubble level attached to the cantilever grip arm, the brace arm, or the attachment means.

12. An exercise device, comprising:

a barbell shaft having a longitudinal axis, a midpoint, first and second bar end's, a first collar proximate the first end and a second collar proximate the second end, a first end portion of the shaft extending beyond the first collar to the first end and a second end portion of the shaft extending beyond the second collar to the second end, the first and second end portions configured to receive weight plates, and a middle portion of the shaft located between the first and second collars;

first and second weight plates resting on and temporarily secured to the first and second end portions, respectively, of the barbell shaft;

first and second barbell grips each having respective an attachment means removably attaching the barbell grip to the middle portion of the barbell shaft, a cantilever grip arm having an inner end and an outer end, the inner end mechanically coupled to the attachment means, the cantilever grip arm configured to extend from the attachment means normally or obliquely with respect to the longitudinal axis of the barbell shaft when the attachment means is attached to the barbell shaft, and a brace arm having an inner end and an outer end, the inner end of the brace arm mechanically coupled to the attachment means, the brace arm configured to extend from the attachment means normally or obliquely with respect to the longitudinal axis of the barbell shaft and normally or obliquely with respect to the cantilever grip arm when the attachment means is attached to the barbell shaft, the barbell grips removably attached to the barbell shaft at two respective points approximately equidistant from the midpoint toward the first and second end portions respectively, so that the cantilever grip arm of the first barbell grip and the cantilever grip arm of the second barbell grip extend normally or obliquely with respect to the barbell shaft longitudinal axis in a horizontal plane, and the brace arm of the first barbell grip and the brace arm of the second barbell grip extend downward from the horizontal plane.

13. The exercise device of claim 12, wherein the cantilever grip arms of the first and second barbell grips are angled outwardly from the midpoint away from each other and toward the first and second bar ends, respectively.

14. The exercise device of claim 12, wherein the cantilever grip arms of the first and second barbell grips extend from the respective attachment means at an angle toward each other and toward the midpoint.

15. The exercise device of claim 12, wherein the brace arms of the first and second barbell grips extend from the respective attachment means at an angle away from each other and toward the first and second bar ends, respectively.

16. The exercise device of claim 12, wherein the first and second barbell grips each includes a bubble level and the bubble levels include indicators that are configured to have the same reading when the barbell grips are placed in a parallel orientation on the barbell.

17. The exercise device of claim 12, wherein the cantilever grip arms are configured to extend normally to the longitudinal axis of the barbell shaft when their respective attachment means are attached to the barbell shaft, and wherein the inner ends of the respective brace arms are configured to extend downwardly from the respective attachment means so that each brace arm forms an acute angle with the respective cantilever grip arm.

18. The exercise device of claim 12, wherein the brace arms are curved to conform with the forearm of a person gripping the cantilever grip arms to perform a neutral grip weightlifting exercise with the barbell to which the barbell grips are attached.

19. A method of exercising by a person using a barbell having a barbell shaft, a longitudinal axis, middle portion, first and second end portions with weight plates of equal weight attached to the first and second end portions of the barbell, and a pair of barbell grips, each barbell grip having an attachment means for removably attaching the barbell grip to the middle portion of the barbell shaft;

a cantilever grip arm having an inner end and an outer end, the inner end mechanically coupled to the attachment means, the cantilever grip arm configured to extend from the attachment means normally or obliquely with respect to the longitudinal axis of the barbell shaft when the attachment means is attached to the barbell shaft;

a brace arm having an inner end and an outer end, the inner end of the brace arm mechanically coupled to the attachment means, the brace arm configured to extend from the attachment means normally or obliquely with respect to the longitudinal axis of the barbell shaft and normally or obliquely with respect to the cantilever grip arm when the attachment means is attached to the barbell shaft, the method comprising:

attaching the first and second barbell grips to the barbell shaft in a parallel orientation by their respective attachment means;

positioning the person's body on a bench perpendicular to and under the barbell with the barbell on a rack with the person's chest below a horizontal plane of the barbell shaft;

gripping the first and second barbell grips with a neutral grip;

raising the barbell from the rack;

lowering the barbell toward the chest;

raising the barbell from the chest so that arms are fully extended by lifting the first and second barbell grips;

returning the barbell to the rack; and after returning the barbell to the rack, removing the first and second barbell grips from the bar.

20. The method of exercising of claim 19, further comprising:

aligning the first and second barbell grips on the barbell using bubble levels attached to the barbell grips.

* * * * *